US006579079B2

(12) United States Patent
Krevald

(10) Patent No.: US 6,579,079 B2
(45) Date of Patent: Jun. 17, 2003

(54) ROTARY VALVE AND PISTON PUMP ASSEMBLY AND TANK DISPENSER THEREFOR

(75) Inventor: Walter R. Krevald, Des Plaines, IL (US)

(73) Assignee: Diamond Machine Werks, Inc., Elk Grove, IL (US)

( * ) Notice: Subject to any disclaimer, the term of this patent is extended or adjusted under 35 U.S.C. 154(b) by 86 days.

(21) Appl. No.: 09/965,061

(22) Filed: Sep. 27, 2001

(65) Prior Publication Data

US 2003/0059323 A1 Mar. 27, 2003

(51) Int. Cl.[7] ..... F04B 7/00
(52) U.S. Cl. ..... 417/510; 222/137
(58) Field of Search ..... 417/510, 517, 417/461, 519; 137/99, 312; 222/137, 309; 303/116.4; 141/91; 425/557; 239/127

(56) References Cited

U.S. PATENT DOCUMENTS

| | | | | | |
|---|---|---|---|---|---|
| 3,669,319 | A | * | 6/1972 | Sanz | 222/309 |
| 3,672,389 | A | * | 6/1972 | McConnell et al. | 137/99 |
| 3,684,409 | A | * | 8/1972 | Sanz et al. | 417/519 |
| 3,985,652 | A | | 10/1976 | Cooper | |
| 4,207,929 | A | | 6/1980 | Stoner | |
| 4,545,507 | A | * | 10/1985 | Barall | 222/137 |
| 4,551,072 | A | | 11/1985 | Barall | |
| 4,730,648 | A | * | 3/1988 | Walter | 141/91 |
| 4,747,541 | A | * | 5/1988 | Morine et al. | 239/127 |
| 4,964,434 | A | | 10/1990 | Bieri | |
| 5,383,491 | A | | 1/1995 | Heilman | |
| 5,478,217 | A | * | 12/1995 | Jones | 417/461 |
| 5,716,111 | A | * | 2/1998 | Schenk et al. | 303/116.4 |
| 5,718,570 | A | * | 2/1998 | Beckett et al. | 417/517 |
| 5,858,420 | A | * | 1/1999 | Szajak et al. | 425/557 |
| 6,206,663 | B1 | | 3/2001 | Frenken | |
| 6,431,202 | B1 | * | 8/2002 | Ahlgren et al. | 137/312 |

FOREIGN PATENT DOCUMENTS

| | | | | |
|---|---|---|---|---|
| FR | 2639066 | * | 5/1990 | B67D/5/46 |
| JP | 404169056 | * | 6/1992 | H01M/2/36 |

OTHER PUBLICATIONS

Hibar Systems Ltd., "Hiar Metering Pump 1BR10191", Technical Drawing Of Commercial Product, Dec. 18, 1998.

* cited by examiner

*Primary Examiner*—Teresa Walberg
*Assistant Examiner*—Leonid M Fastovsky
(74) *Attorney, Agent, or Firm*—James P. Hanrath

(57) ABSTRACT

A rotary valve, a piston pump rotary valve assembly and a piston pump rotary valve assembly tank dispenser for use in discharging a metered amount of liquid, gel, or slurry has a valve body having a first channel pathway and a second channel pathway. The first channel pathway has an inlet opening to receive a liquid, gel, or slurry and an outlet opening to provide the same to a pathway of the piston pump assembly. The second channel pathway is segregated from the first channel pathway and includes a plurality of inlet openings, each capable of communicative alignment with the pathway of the piston pump assembly, and at least one outlet opening communicative with such inlet openings. The valve body is capable of rotation with respect to the piston pump assembly to dispose both the first channel pathway and the second channel pathway each to two operative positions to receive the liquid, gel, or slurry and to two inoperative positions blocking fluid communication with the liquid, gel, or slurry.

38 Claims, 10 Drawing Sheets

14
18
114
100
130
34
130
124
24
22
98
112
26

112
14
C
112
14
166
10
18
98
16
138
100
168
114
84
34
132
112
146
148
170
134
152
150
24
76
26

ROTARY VALVE AND PISTON PUMP ASSEMBLY AND TANK DISPENSER THEREFOR

BACKGROUND OF THE INVENTION

1. Field of the Invention.

The present invention relates generally to an alternate recharge and discharge rotary valve for use in a piston pump assembly to discharge a metered amount of liquid, gel, or slurry, and particularly a rotary valve having a first channel pathway segregated from a second fluid pathway, the first channel pathway providing a metered amount of liquid, gel, or slurry to a piston bore pathway and the second channel pathway providing an exit to dispense the same. The present invention is particularly useful to dispense gel or slurry used in battery fills, however, it is understood that the invention is not limited to this particular application.

2. Description of the Related Art.

A variety of metering piston pumps are used in many environments were a precisely measured quantity of a liquid is required to be dispensed. Examples of such applications are in the packaging of liquid medicaments and perfumes. A typical metering pump for this purpose employs a reciprocating plunger to draw a charge of liquid into a cylinder and then expelled the charge from the pump at each reciprocation of the plunger. The liquid enters and leaves the cylinder through the same port, and a rotary valve is provided to place the port, alternatively, in communication with the supply of liquid and an outlet from the pump. However both entry and exit of the metered liquid into a cylinder from the same port can be disadvantageous, particularly in a number of metering piston pump applications involving dense liquids, gel, or slurries. In such applications the consistency of the dispensed liquid, gel or slurry can vary, contain contaminants, form lump-like portions, or develop cling sediment, thereby causing problems of restricted or clogged entry or dispensing pathways.

SUMMARY OF THE INVENTION

In accordance with the present invention there is provided a rotary valve for use in a piston pump assembly to discharge a metered amount of liquid, gel, or slurry comprising a valve body having a first channel pathway and a second channel pathway. The first channel pathway has an inlet opening to receive a liquid, gel, or slurry and an outlet opening to provide the liquid, gel, or slurry to a pathway of the piston pump assembly. The second channel pathway has a plurality of inlet openings each capable of communicative alignment with the pathway of the piston pump assembly and at least one outlet opening communicative with said inlet openings. Preferably the second channel pathway is generally X-shaped, having an upper distal side opening and an upper proximal side opening at an upper portion thereof and a lower distal side opening and a lower proximal side opening at a lower portion thereof. The valve body is capable of rotation with respect to the piston pump assembly to dispose the inlet opening of the first channel pathway to both an operative position to receive the liquid, gel, or slurry through the inlet opening of the first channel pathway and provide the same to the outlet opening of the first channel pathway, and an inoperative position closing the first channel pathway from fluid communication with the liquid, gel, or slurry. The valve body is further capable of rotation with respect to the piston pump assembly to separately dispose the second channel pathway to an operative position to discharge the liquid, gel, or slurry from the piston pump assembly and an inoperative position to prevent the discharge. The present invention also encompasses a piston pump rotary valve assembly for use in discharging a metered amount of liquid, gel or slurry and also such an assembly, and preferably a plurality of such assemblies in combination with a tank dispenser.

The present invention advantageously provides for a fill or recharge cycle of a metered amount of liquid, gel or slurry from the first channel pathway of the rotary valve to a piston pump pathway which is distinct, divided, and separated from a discharge cycle wherein the liquid, gel or slurry is discharged from the piston pump pathway. Further, the present invention advantageously allows for a four cycle location rotation of the rotary valve at each quarter turn thereof relative to the piston pump pathway which establishes an "alternate recharge and discharge", and "fresh-in, fresh-out" mode of operation for the subject liquid, gel or slurry in the piston pump pathway. Such a four cycle location of the rotary valve provides for a piston pump pathway fill to discharge to fill to discharge sequence relative to the piston pump assembly. Moreover, by exhausting all liquid, gel or slurry from the piston pump pathway during discharge cycles, fresh liquid, gel, or slurry is always provided during fill cycles of the piston pump pathway. Still further, the rotary valve of the present invention importantly has an end portion which rotatably functions as an impeller to stir liquid, gel, or slurry within an impeller displacement zone thereby breaking up clumps, sediment, impurities, or lack of consistency in the liquid, gel, or slurry just prior to entry of the same to the first channel pathway of the rotary valve which supplies the liquid, gel, or slurry to the piston pump pathway. Such advantages allow the rotary valve, the rotary valve assembly, and the rotary valve assembly tank dispenser of present invention to be used with caustic gels or slurries which contain contaminants, form lump-like portions, or otherwise feature variations in their consistency while limiting or altogether eliminating development of cling sediment which can cause serious problems of restricted or clogged piston pump or rotary valve entry or dispensing pathways necessitating maintenance and repair and associated system downtime.

Additional features and advantages of the present invention will become apparent to those skilled in the art from the following description and the accompanying figures illustrating preferred embodiments of the invention, the same being the present best mode for carrying out the invention.

DESCRIPTION OF THE PREFERRED EMBODIMENTS

Figure 1:
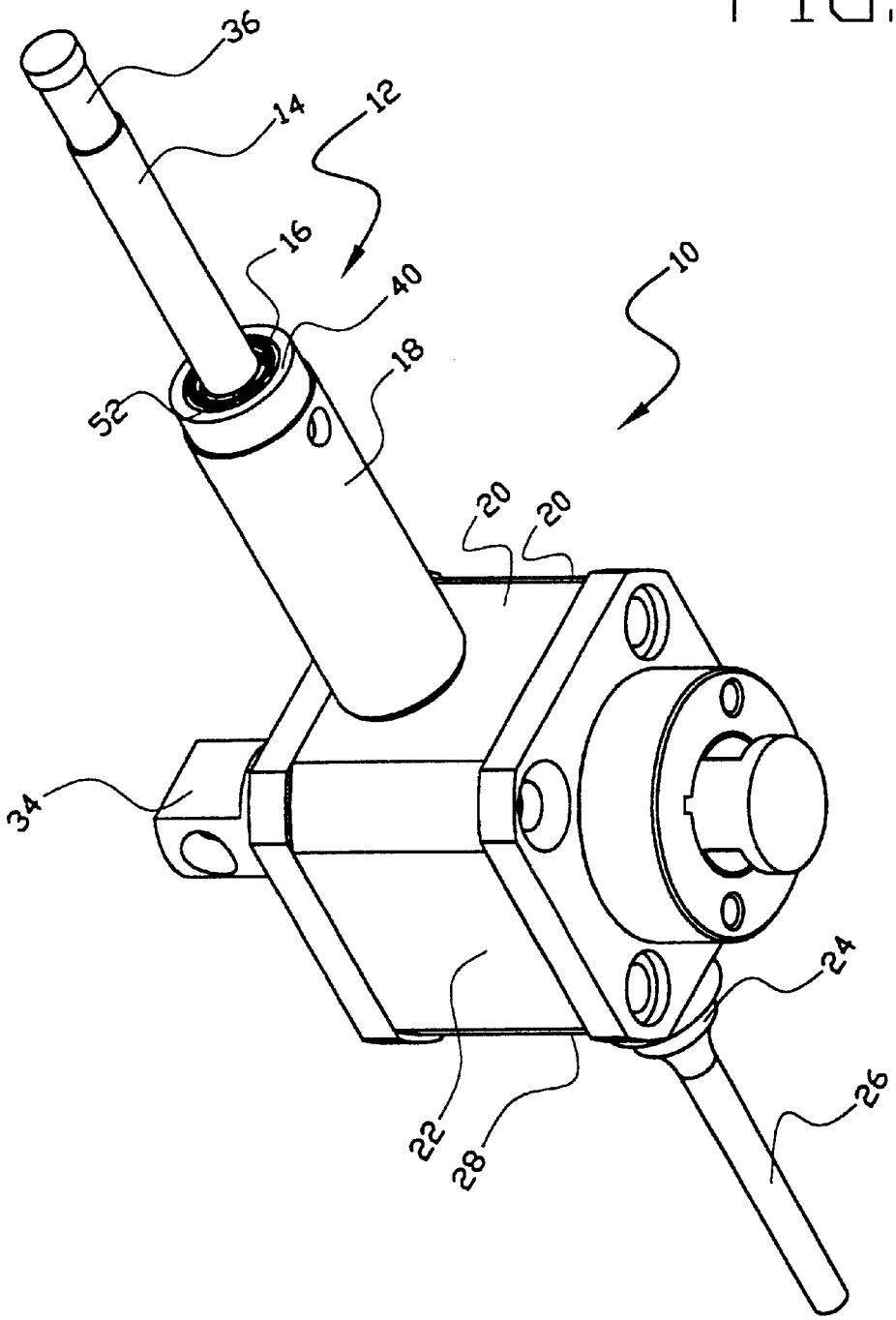
FIG. 1 is a perspective view of a piston pump rotary valve assembly constructed in accordance with the teachings of the present invention.
Figure 2:
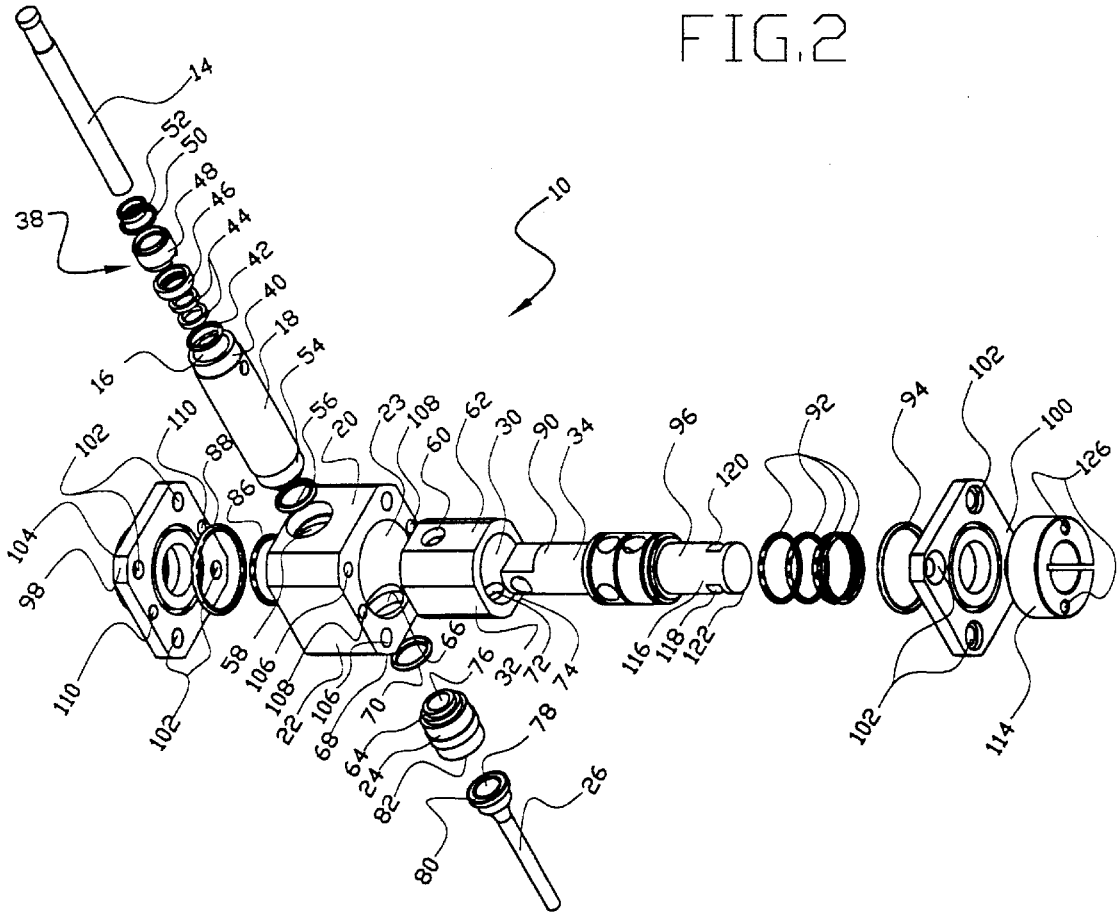
FIG. 2 is an exploded perspective view of the piston pump rotary valve assembly of FIG. 1 showing the component parts thereof axially exploded from each other.

Referring now to the drawings, there is shown in FIG. 1 a perspective unitary view of a piston pump rotary valve assembly 10 of the present invention while in FIG. 2, the piston pump rotary valve assembly 10 is illustrated with the various component parts thereof axially exploded from each other. Piston pump rotary valve assembly 10 includes a piston pump 12 having a piston 14 axially aligned for operative movement within a piston bore pathway 16 of a piston body 18. Piston body 18 is attached to an upper surface 20 of a valve housing 22 and a nozzle mount 24 servicing attached nozzle 26 is attached at a lower surface 28 of the valve housing 22. The valve housing 22 includes a housing opening 23 (see FIG. 2) to accommodate axial insertion of an inner sleeve 32 into which a rotary valve 34 is set.

As better viewed in the vertically exploded component parts illustrated at FIG. 2, the piston 14 includes an outer end 36 which is cooperative with a reciprocal drive means known within the piston arts to retract the piston 14 from and drive the same into piston bore pathway 16 of the piston body 18. Piston body 18 preferably includes a packing assembly 38 at an outer end 40 thereof which consists of an arbitrary array of sealing parts complementary of the piston 14 such as, respectively, lower lip seal 42 and o-rings 44 providing a lower seal to inner seal packing spacer 46, an outer seal packing spacer 48, an o-ring 50 providing an upper seal upon the outer seal packing spacer 48, and an upper lip seal 52. An inner threaded end 54 of the piston body 18 is screw thread mounted and o-ring 56 sealed to an upper threaded bore 58 of the upper surface 20 of the valve housing 22. Once so mounted, the piston bore pathway 16 of piston body 14 is set in vertical axial alignment with upper bore hole 60 at the upper surface 62 of the inner sleeve 32 such as to provide a entry fluid communication from piston body 18 through the upper bore hole 60 of inner sleeve 32 to the rotary valve 34. Likewise, the nozzle mount 24 has a treaded head 64 which is similarly screw thread mounted to a lower threaded bore 66 of a lower surface 68 of the valve housing 22 and o-ring 70 sealed. Once so mounted, the nozzle mount is set in a vertical axial alignment to provide an exit fluid communication from rotary valve 34 through a lower bore hole 72 at a lower surface 74 of the inner sleeve 32, through the lower threaded bore 66 of the lower surface 68 of the valve housing 22, and to a nozzle mount bore pathway 76 of the nozzle mount 24 for final discharge from a nozzle discharge pathway 78 of the nozzle 26. As previously noted, the lower surface 68 of the valve housing 22 has a threaded bore 66 to receive an o-ring 70 sealed inner threaded head 64 of the nozzle mount 24. Once the nozzle mount 24 is joined to the valve housing 22, an outer thread end 80 of the nozzle 26 is thread mounted to an inner thread end 82 of nozzle mount 24. As will be more fully illustrated and discussed hereinafter, the upper bore hole 60 of inner sleeve 32 is offset from and not in vertical axial alignment with the lower bore hole 72 of inner sleeve 32 in order to accommodate a second channel pathway 84 of rotary valve 34.

Referring now to the horizontally exploded component parts illustrated at FIG. 2, the rotary valve 34 is axially set within the sleeve opening 30 of the inner sleeve 32 and both component parts are sealed within housing opening 23 of valve housing 22 by an arbitrary array of complementary sealing parts. In this regard, o-rings 86 and 88 are set upon a proximal end 90 of the rotary valve 34 and o-rings 92 and 94 are set upon a distal end 96 of the rotary valve 34 to provide a distal and proximal seal respectively against a proximal end cap 98 and a distal end cap 100 of the valve housing 22. The proximal end cap 98 and the distal end cap 100 are each provided with a plurality of corner threaded through bores 102, one at each of the four corners of their annular side periphery 104, which are complimentary axial aligned such that the proximal end cap 98 and distal end cap 100 can be screw mated through the corresponding aligned plurality of corner through holes 106 of valve housing 22. The valve housing 22 also has a pair of central through holes 108 which are complimentary axially aligned with central through holes 110 of proximal end cap 98 so as to accommodate an accurate dowel pin secure attachment of the piston pump rotary valve assembly 10 with complementary dowel holes of a fill tank 112 (see FIG. 10).

FIG. 2 further illustrates that a clamp collar 114 may be optionally provided for clamp fitting to a inward portion 116 of distal end 96 of rotary valve 34 while exposing actuator engaging location flats 118 and 120 located at and an outer portion 122 of the distal end 96 of the rotary valve 34.

Figure 3:
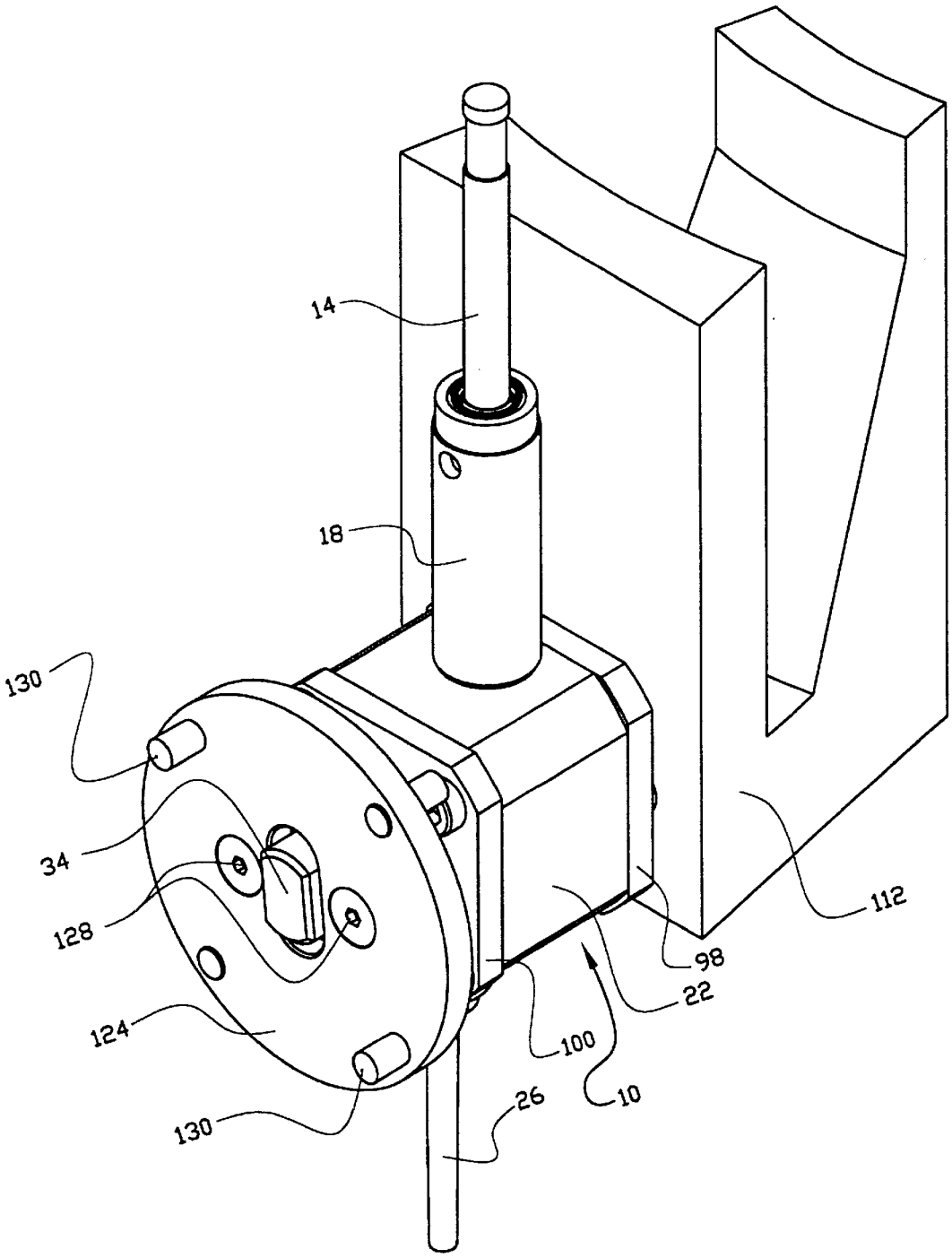
FIG. 3 is a perspective view of the piston pump rotary valve assembly of FIG. 1 connected to a fragmentary portion of a tank dispenser and to an actuator capable of rotating the component rotary valve of the piston pump rotary valve assembly.
Figure 4:
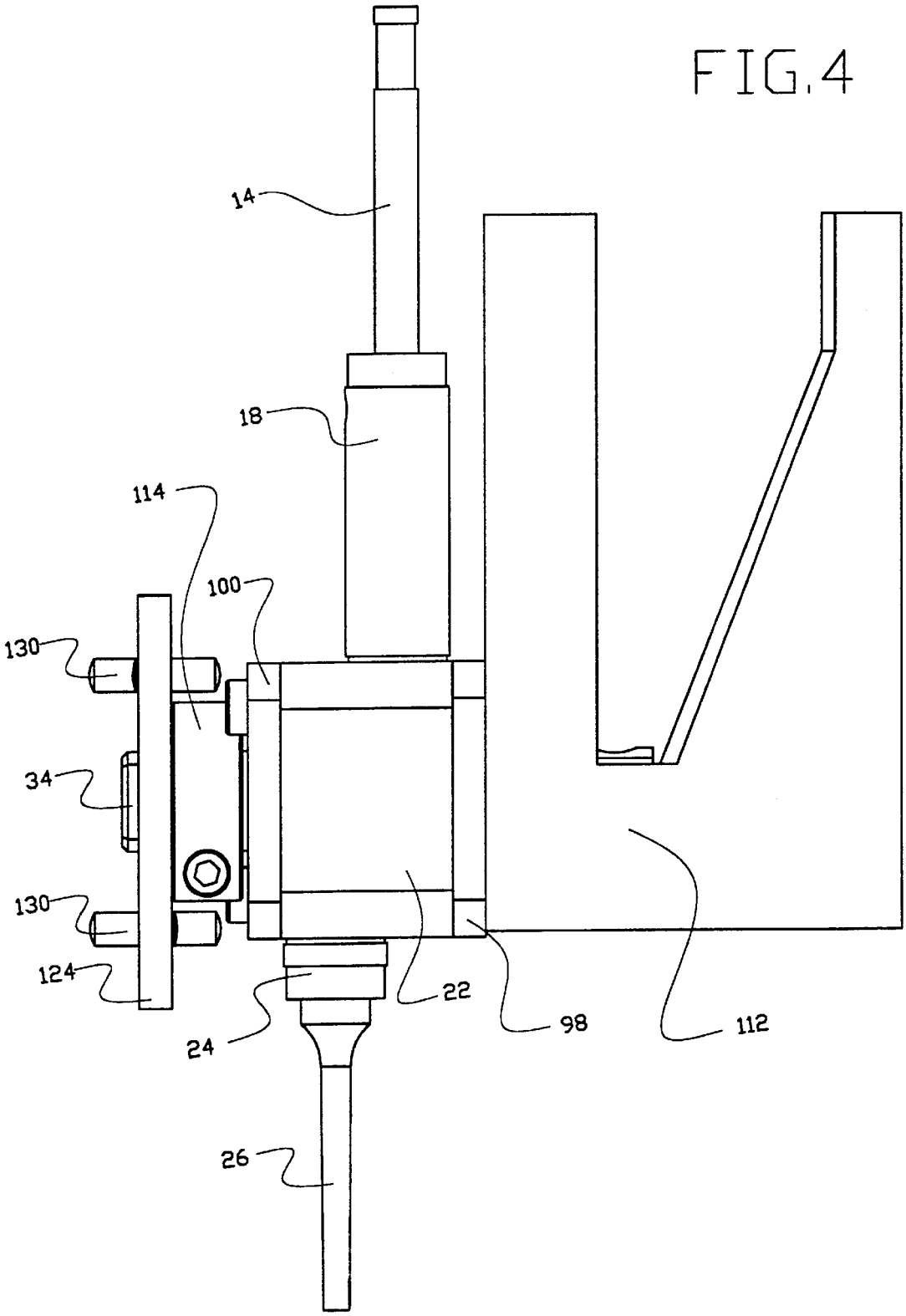
FIG. 4 is a side view of the piston pump rotary valve assembly, the fragmentary portion of the tank dispenser, and the actuator of FIG. 3.

The perspective view of FIG. 3 and the side view of FIG. 4 illustrate the piston pump rotary valve assembly 10 described above mounted to a fill tank 112 and an actuator 124. In this regard, the piston pump rotary valve assembly 10 at proximal end cap 98 is dowel pin attached as discussed above to the fill tank 112. The clamp collar 114 is provided with a pair of threaded bores 126 such that actuator 124 can be screw set mated to clamp collar 114 by actuator set screws 128. The actuator engaging location flats 118 and 120 of rotary valve 34 are set in operative relationship with the actuator 124 by virtue of actuator rotary translation heads 130 being in operative connection with mechanical, pneumatic, hydraulic, or other rotary drive means well-known in the actuator arts to accomplish rotary turning of rotary valve 34.

The preferred embodiment of rotary valve 34 is illustrated in FIG. 5 through FIG. 9.

Figure 5:
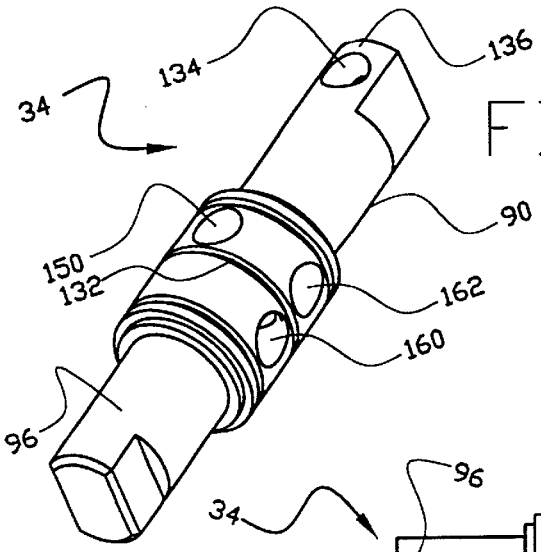
FIG. 5 is a perspective view of the component rotary valve of FIG. 2.

In the perspective view of FIG. 5, the rotary valve 34 includes a proximal end 90, a distal end 96, and a middle section 132 of a greater diameter than such ends. The proximal end 90 includes an inlet opening 134 which is exposed opened to an upper surface 136 of the proximal end 90.

Figure 6:
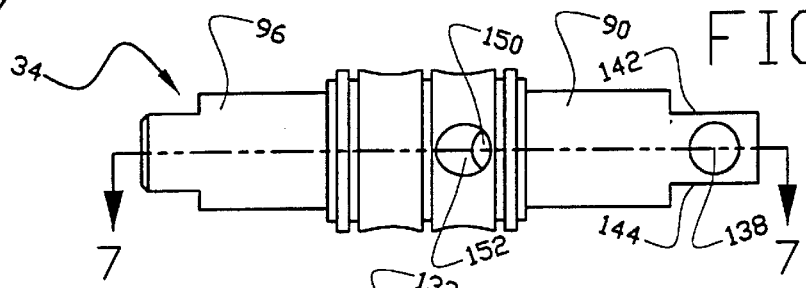
FIG. 6 is a top view of the component rotary valve of FIG. 5.
Figure 7:
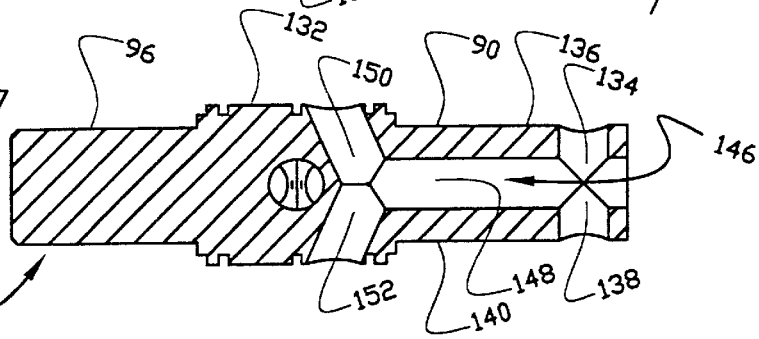
FIG. 7 is a sectional view of the component rotary valve of FIG. 5, taken long lines 7—7 of FIG. 6, and illustrates a first channel pathway to provide a liquid, gel or slurry to a piston pump pathway.

As best observed in the sectional view of FIG. 7 taken along line 7—7 of FIG. 6, the inlet opening 134 neighboring the upper surface 136 of proximal end 90 is axially aligned to a preferred second inlet opening 138 neighboring a lower surface 140 of the proximal end 90 while being closed to a first side surface 142 and a second side surface 144 (see FIG. 6) of the proximal end 90. The rotary valve 34 has a first channel pathway 146 which consists of inlet opening 134 and axially aligned second inlet opening 138, a bore passage 148 which is at least partially substantially perpendicular to the inlet opening 134 and second inlet opening 138, a first branch outlet opening 150 angled from the bore passage 148 and a second branch outlet opening 152 angled from the bore passage 148. As will be detailed hereinafter, the first channel pathway 146 receives liquid, gel, or slurry from a fill tank 112 through the inlet opening 134 and second inlet opening 138 and provides the same to the piston bore pathway 16.

Figure 8:
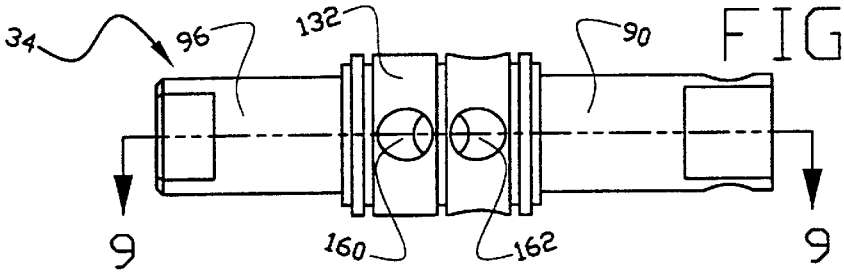
FIG. 8 a side view of the component rotary valve of FIG. 5.
Figure 9:
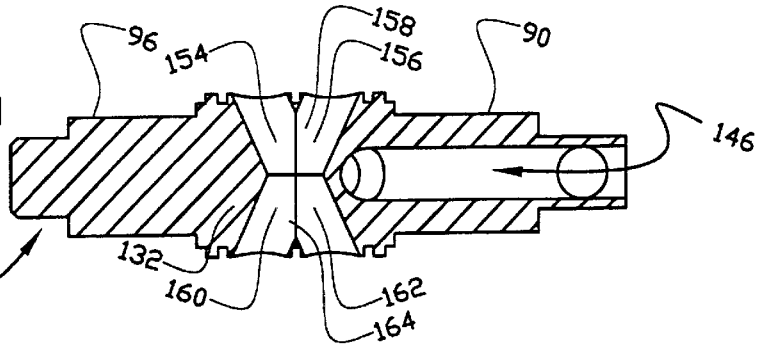
FIG. 9 is a sectional view of the component rotary valve of FIG. 5, taken long lines 9—9 of FIG. 8, and illustrates a second channel pathway for discharge of the liquid, gel or slurry from the piston pump pathway.

As best observed in the sectional view of FIG. 9 taken along line 9—9 of FIG. 8, the rotary valve 34 includes a second channel pathway 84 which is distinct and segregated from the first channel pathway 146 of the rotary valve 34. The second channel pathway 84 could take a variety of forms provided that it has a plurality of inlet openings each capable of communicative alignment with the piston bore pathway 16 of the piston pump rotary valve assembly 10 and at least one outlet opening communicative with such second channel pathway inlet openings. As illustrated in FIG. 9 the second channel pathway 84 preferably is generally X-shaped having an upper distal side opening 154 and an upper proximal side opening 156 at an upper portion 158 of its general X-shape and a lower distal side opening 160 and a lower proximal side opening 162 at a lower portion 164 of its general X-shape.

The operation of the rotary valve 34 of the present invention and its first channel pathway 146 and second channel pathway 84 relative a piston pump rotary valve assembly 10 is illustrated in FIG. 12 through FIG. 15.

Figure 12:
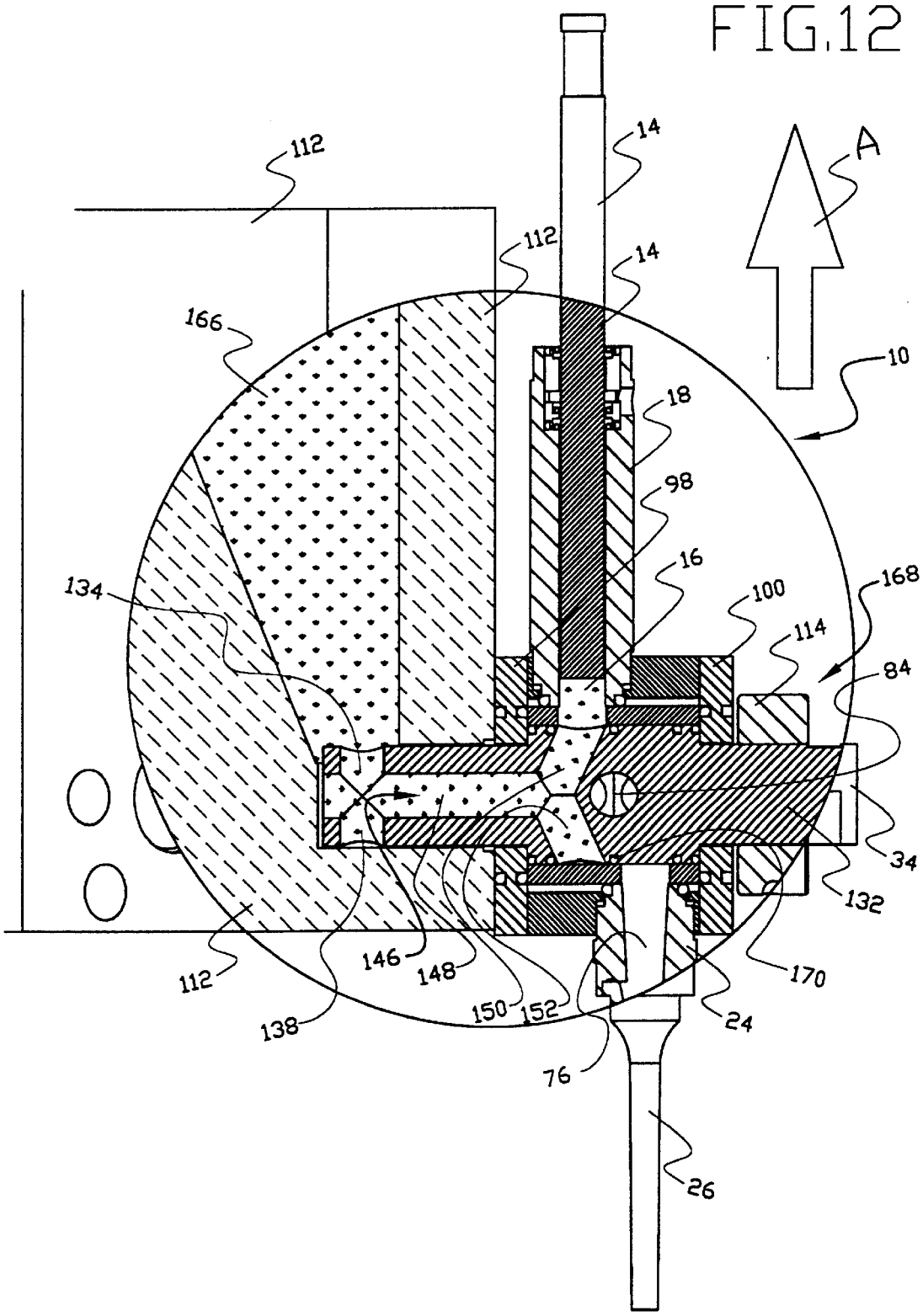
FIG. 12 is a sectional view of a piston pump rotary valve assembly communicative with liquid, gel, or slurry from a fill tank and illustrates a first cycle location of the rotary valve wherein the first channel pathway is in a first operative fill position to provide liquid, gel, or slurry to the piston pump pathway.

FIG. 12 is a sectional view of a piston pump rotary valve assembly 10 communicative with liquid, gel, or slurry 166 from a fill tank 112 and illustrates a first cycle location 168 of the rotary valve 34 wherein the first channel pathway 146 is in a first operative fill position to provide the liquid, gel, or slurry 166 to the piston pump pathway 16 per piston 14 being in a fill suction mode with the liquid, gel, or slurry 166 moving in product flow direction A. The first cycle location 168 of the rotary valve 34 disposes inlet opening 134 of the first channel pathway 146 to an operative open position relative the liquid, gel or slurry 166 contained in fill tank 112 allowing the liquid, gel or slurry 166 to gravity/suction feed into the inlet opening 134, the axially aligned second inlet opening 138, the bore pathway 148, and outlet opening 150 of the first channel pathway 146, so as to fill a metered amount of the liquid, gel, or slurry 166 into piston bore pathway 16 by suction upon withdrawal or up-stroke of piston 14. During this first cycle location of the rotary valve 34, the second channel pathway 84 of rotary valve 34 has been vertically rotated to a first inoperative position wherein the second channel pathway 84 is orientated traverse to the piston bore pathway 16 and the inner annular wall surface 170 of the middle section 132 of the rotary valve 34 blocks the liquid, gel, or slurry 166 from fluid communication into nozzle mount bore pathway 76 of the nozzle mount 24 for final discharge from the nozzle 26.

Figure 13:
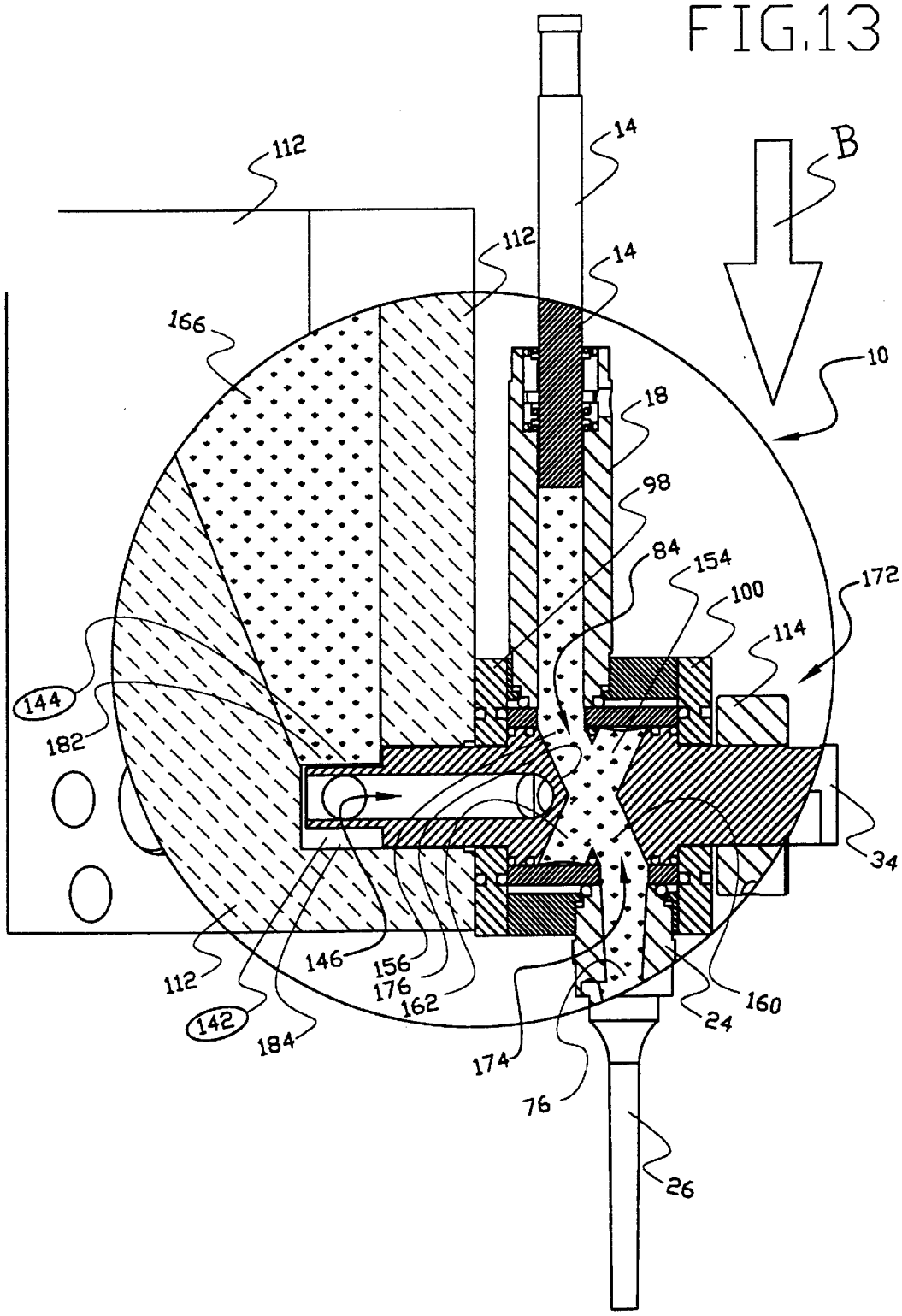
FIG. 13 is a sectional view of a piston pump rotary valve assembly blocked from communication with liquid, gel, or slurry from a fill tank, and illustrates a quarter turn of the rotary valve to a second cycle location wherein the second channel pathway is in a first operative discharge position to receive a liquid, gel, or slurry from the piston pump pathway.

FIG. 13 is a sectional view of a piston pump rotary valve assembly 10 blocked from communication with the liquid, gel, or slurry 116 from the fill tank 112, and illustrates a quarter turn of the rotary valve from its first cycle location 168 to a new second cycle location 172 wherein the second channel pathway 84 is in a first operative discharge position to receive the liquid, gel, or slurry 166 from the piston pump pathway 16 and allow for ultimate discharge of the same per piston 14 being in a drive discharge mode due with the liquid, gel, or slurry 166 of piston pump pathway being in product flow direction B. The second cycle location 172 of the rotary valve 34 is a first operative position of the second channel pathway 84 wherein the upper proximal side opening 156 and the lower distal side opening 160 of the second channel pathway 84 defines an angled discharge pathway 174 for the metered amount of liquid, gel, or slurry 166 taken into piston bore pathway 16 during the previous first cycle location 168 of rotary valve 34. When piston 14 moves down-stroke to a drive or discharge position within the piston bore pathway 16, the liquid, gel, or slurry 166 within piston bore pathway 16 enters the upper proximal side opening 156 of the second channel pathway 84 and passes downwardly and angularly to the lower distal side opening 160 of the second channel pathway 84 for entry into nozzle mount bore pathway 76 of the nozzle mount 24 for final discharge from the nozzle 26. During the second cycle location 172, the first channel pathway 146 of rotary valve 34 has been vertically rotated a quarter turn disposing the second side surface 144 of the proximal end 90 of rotary valve 34 to the liquid, gel, or slurry 166 contained in tank 112 thereby closing the first channel pathway 146 to the same and establishing a first inoperative position of the first channel pathway. At second cycle location 172, the first channel pathway 146 is orientated traverse to the piston bore pathway 16 and the interior wall surface 176 of the middle section 132 of the rotary valve 34 segregates the liquid, gel, or slurry 166 being driven from piston bore pathway 16 from first channel pathway 146.

Figure 14:
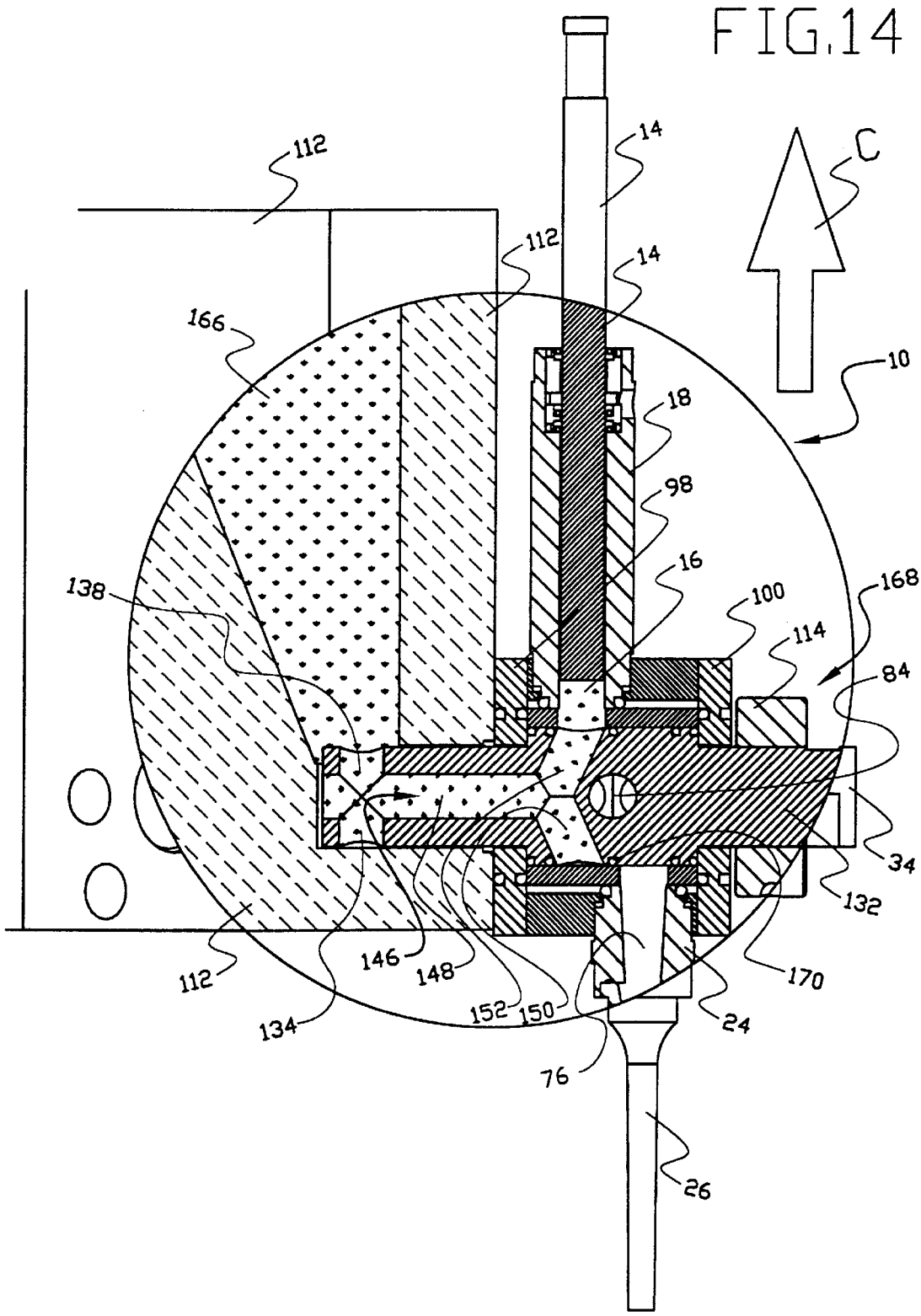
FIG. 14 is a sectional view of a piston pump rotary valve assembly communicative with liquid, gel, or slurry from a fill tank, similar to FIG. 12, and illustrates another quarter turn of the rotary valve to a third cycle location wherein the first channel pathway is in an operative recharge fill position to provide liquid, gel, or slurry to the piston pump pathway.

FIG. 14 is a sectional view of a piston pump rotary valve assembly 10 communicative with liquid, gel, or slurry 166 from a fill tank 112 which is similar to FIG. 12. FIG. 13 illustrates another quarter turn of the rotary valve 34 from the second cycle location 172 to a new third cycle location 178 of the rotary valve 34 wherein the first channel pathway 146 is in a second operative recharge position to again provide the liquid, gel, or slurry 166 to the piston pump pathway 16 per piston 14 being in a recharge suction mode with the liquid, gel, or slurry 166 moving in product flow direction C. The third cycle location 178 of the rotary valve 34 disposes second inlet opening 138 of the first channel pathway 146 to an operative open position relative the liquid, gel or slurry 166 contained in fill tank 112 allowing the liquid, gel or slurry 166 to gravity/suction feed into the second inlet opening 138, the axially aligned inlet opening 134, the bore pathway 148, and outlet opening 152 of the first channel pathway 146, so as to fill a metered amount of the liquid, gel, or slurry 166 into piston bore pathway 166 by suction upon withdrawal or recharge up-stroke of piston 14. During this third cycle location of the rotary valve 34, the second channel pathway 84 of rotary valve 34 has been vertically rotated to a second inoperative position wherein the second channel pathway 84 is again orientated traverse to the piston bore pathway 16 and the inner annular wall surface 170 of the middle section 132 of the rotary valve 34 again blocks the liquid, gel, or slurry 166 from fluid communication into nozzle mount bore pathway 76 of the nozzle mount 24 for final discharge from the nozzle 26.

Figure 15:
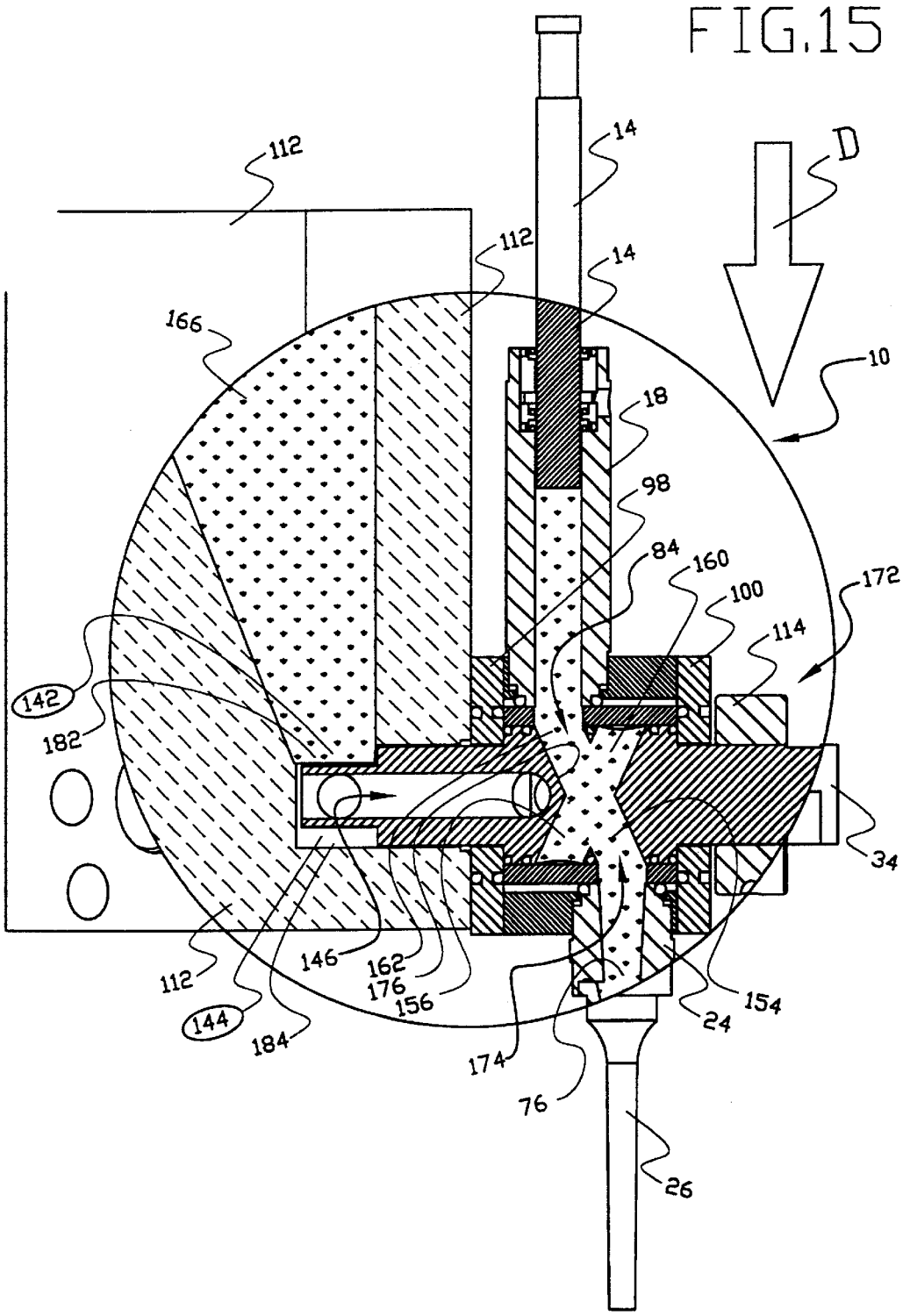
FIG. 15 is a sectional view of a piston pump rotary valve assembly blocked from communication with liquid, gel, or slurry from a fill tank, and illustrates yet another quarter turn of the rotary valve to a fourth cycle location wherein the second channel pathway is in a second operative discharge position to receive a liquid, gel, or slurry from the piston pump pathway.

FIG. 15 is a sectional view of a piston pump rotary valve assembly 10 again blocked from communication with the liquid, gel, or slurry 116 from the fill tank 112, which is similar to FIG. 13. FIG. 15 illustrates yet another quarter turn of the rotary valve 34 from its third cycle location 178 to a new fourth cycle location 180 wherein the second channel pathway 84 is in a second operative discharge position to receive the recharge liquid, gel, or slurry 166 from the piston pump pathway 16 and allow for ultimate discharge of the same per piston 14 being in a second drive discharge mode with the liquid, gel, or slurry 166 of piston pump pathway moving in product flow direction D. In the fourth cycle location 180, the second channel pathway 84 is disposed such that the lower proximal side opening 162 and the upper distal side opening 154 of the second channel pathway 84 defines an angled discharge pathway 182 for the metered amount of recharge liquid, gel, or slurry 166 taken into piston bore pathway 16 during the previous third cycle location 178 of rotary valve 34. When piston 14 moves down-stroke to a second drive or discharge position within the piston bore pathway 16, the liquid, gel, or slurry 166 within piston bore pathway 16 enters the lower proximal side opening 162 of the second channel pathway 84 and passes downwardly and angularly to the upper distal side opening 154 of the second channel pathway 84 for entry into nozzle mount bore pathway 76 of the nozzle mount 24 for final discharge from the nozzle 26. During the fourth cycle location 180, the first channel pathway 146 of rotary valve 34 has been vertically rotated a quarter turn disposing the first side surface 142 of the proximal end 90 of rotary valve 34 to the liquid, gel, or slurry 166 contained in tank 112 thereby closing the first channel pathway 146 to the same and establishing a second inoperative position of the first channel pathway. At fourth cycle location 172, the first channel pathway 146 is again orientated traverse to the piston bore pathway 16 and the interior wall surface 176 of the middle section 132 of the rotary valve 34 again segregates the liquid, gel, or slurry 166 being driven from piston bore pathway 16 from first channel pathway 146.

The four cycle locations of the rotary valve illustrated at FIG. 12 through FIG. 15 are established by one-quarter circumferential turns of the rotary valve and respectively correspond to four quarterly turns of the rotary valve 34, such as quarterly rotations to a 0 degree first cycle location, a 90 degree second cycle location, a 180 degree third cycle location, and a 270 degree fourth cycle location.

The movement from cycle to cycle through the four cycle locations 168, 172, 178, and 180 provides an important impeller action mixing the liquid, gel, or slurry 166 just prior to any entry of the same into first channel passageway entry. In this regard, as observed by comparing the proximal end 90 of rotary valve 43 as illustrated in FIG. 6 to the same proximal end 90 in FIG. 7 (or comparing the same proximal end 90 in FIG. 8 to FIG. 9), the width from the upper surface 136 to the lower surface 140 surface of proximal end 90 is importantly greater than the width from the first side surface 142 to the second side surface 144 of the rotary valve proximal end 90. This difference allows the rotary valve proximal end 90 to form and define an impeller which stirs and mixes any liquid, gel, or slurry within impeller displacement zones 182 and 184 (see FIG. 13 and FIG. 15)immediately adjacent to first side surface 142 and second side surface 144 respectively of the rotary valve proximal end 90. The liquid, gel, or slurry 166 within impeller displacement zones 182 and 184 is subject to displacement and stirring upon rotary turning of the rotary valve 34 by the greater width of the upper surface 136 to the lower surface 140 of the rotary valve proximal end 90 thereby breaking up clumps, sediment, impurities, or lack of consistency in the liquid, gel, or slurry 166 just prior to entry of the same to the first channel pathway 146 of the rotary valve 34 which supplies the liquid, gel, or slurry to the piston pump pathway 16.

Figure 10:
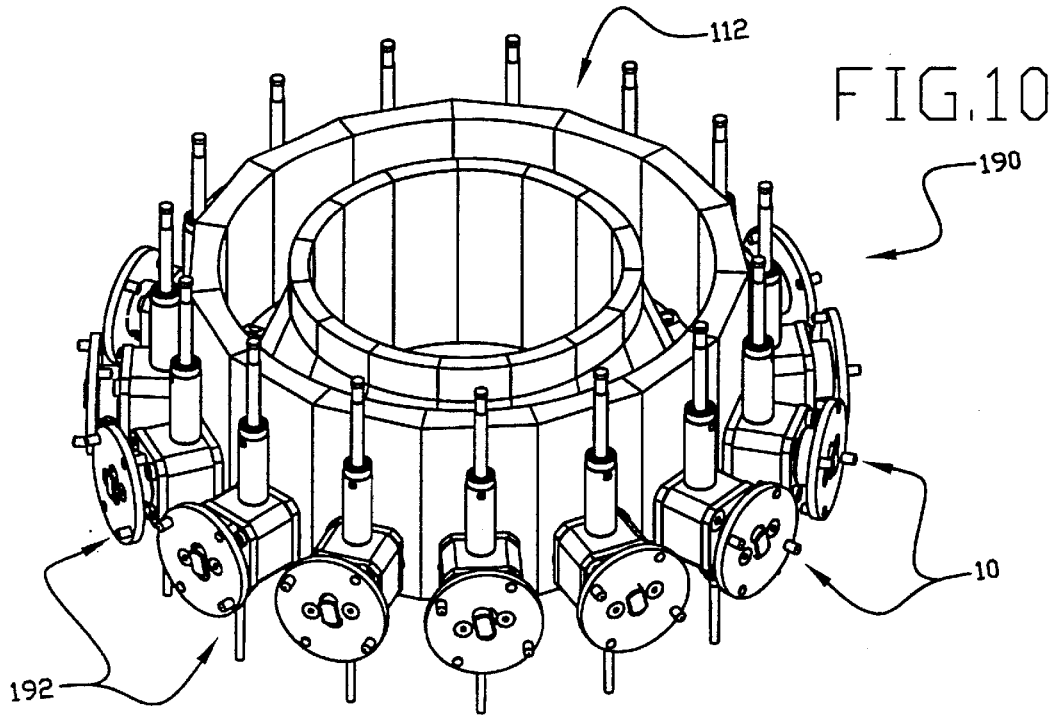
FIG. 10 is perspective view of a piston pump rotary valve assembly tank dispenser constructed in accordance with the teachings of the present invention and illustrates a plurality of piston pump rotary valve assemblies around a fill tank.

FIG. 10 is perspective view of a piston pump rotary valve assembly tank dispenser 190 constructed in accordance with the teachings of the present invention and illustrates a plurality of piston pump rotary valve assemblies 10 mounted in annular alignment about the circumference of a fill tank 112 thereby providing multiple piston pump rotary valve assembly workstations 192 to the piston pump rotary valve tank dispenser 190.

Figure 11:
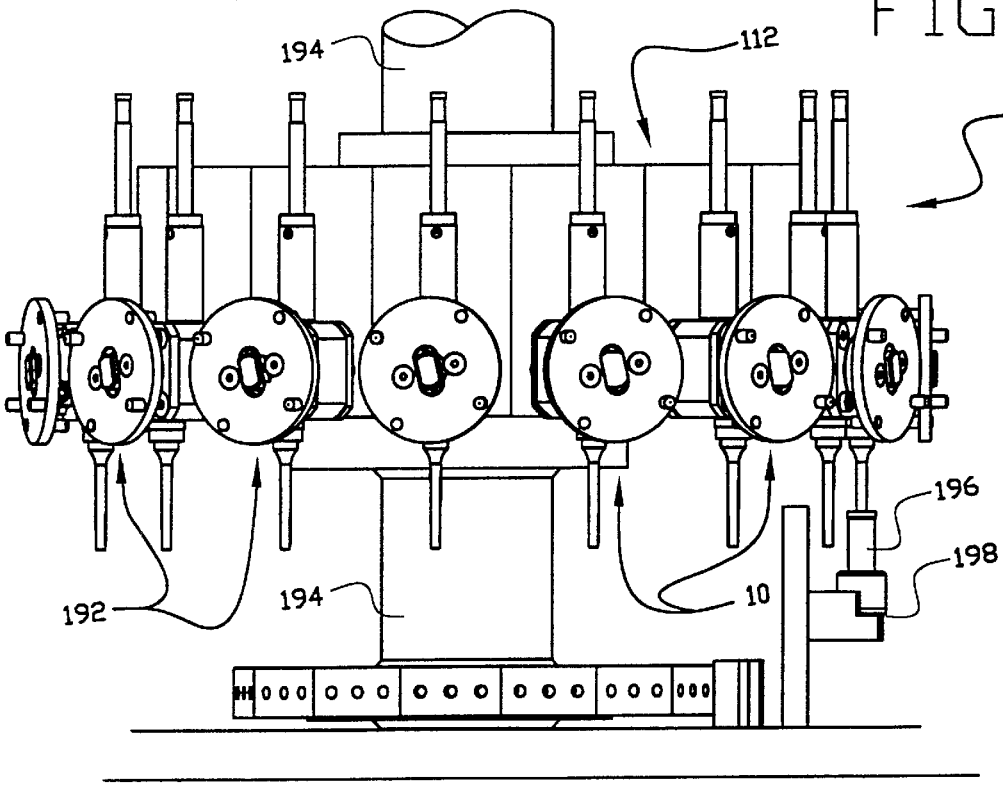
FIG. 11 is a side perspective view of the piston pump rotary valve assembly tank dispenser of FIG. 10 connected to a turret for cooperation with a product supply.

FIG. 11 is a side perspective view of the piston pump rotary valve assembly tank dispenser 190 of FIG. 10 connected to a turret 194 so as to multiple piston pump rotary valve assembly workstations 192 composed of a plurality of piston pump rotary valve assemblies 10 to discharge liquid, gel, or slurry to a workpiece 196 (herein illustrated such as AA battery) set upon a workpiece support 198.

From the foregoing description, it will be apparent that the alternate recharge and discharge rotary valve, rotary valve piston pump assembly, and assembly tank dispenser of the present invention has a number of advantages, some of which have been described above and others of which are inherent in the invention. Also, it will be understood that modifications can be made to the alternate recharge and discharge rotary valve, rotary valve piston pump assembly, and assembly tank dispenser of the present invention, and its component parts, their orientation, or to environments of usage described above without departing from the teachings of the present invention. Accordingly, the scope of the invention is only to be limited as necessitated by the accompanying claims.

I claim:

1. A rotary valve for use in a piston pump assembly to discharge a metered amount of liquid, gel, or slurry comprising a valve body having a first channel pathway and a second channel pathway, said first channel pathway having an inlet opening to receive a liquid, gel, or slurry and an outlet opening to provide said liquid, gel, or slurry to a pathway of said piston pump assembly, said second channel pathway having a plurality of inlet openings each capable of communicative alignment with said pathway of said piston pump assembly and at least one outlet opening communicative with said inlet openings, said valve body being capable of rotation with respect to said piston pump assembly to dispose said inlet opening of said first channel pathway to an operative position to receive fluid communication of said liquid, gel, or slurry through said first channel pathway and provide the same to said pathway of said piston pump assembly and an inoperative position closing said first channel pathway from such fluid communication, and said valve body being capable of rotation with respect to said piston pump assembly to dispose said second channel pathway to an operative position in communicative alignment with said pathway of said piston pump assembly to discharge said liquid, gel, or slurry from said piston pump assembly and an inoperative position to prevent said discharge.

2. The rotary valve of claim 1 wherein said first channel pathway is segregated from said second channel pathway.

3. The rotary valve of claim 1 wherein said second channel pathway it is substantially perpendicular to said inlet opening of said first channel pathway.

4. The rotary valve of claim 1 wherein a portion of said first channel pathway is substantially perpendicular to said inlet opening of said first channel pathway.

5. The rotary valve of claim 1 wherein said outlet opening of said first channel pathway is angled from a portion of said first channel pathway.

6. The rotary valve of claim 1 wherein said second channel pathway rotates on a vertical axis relative said piston-pump assembly.

7. The rotary valve of claim 1 wherein said second channel pathway is disposed in its operable discharge position when rotated in vertical alignment with said piston pump assembly.

8. The rotary valve of claim 1 wherein said second channel pathway is disposed in its inoperable closed position when rotated traverse to said piston pump assembly.

9. The rotary valve of claim 1 wherein said first channel pathway is disposed in its operable receiving position when said second channel pathway is disposed in its inoperable closed position.

10. The rotary valve of claim 1 wherein said second channel pathway is disposed in its operable discharge position when said first channel pathway is disposed in its inoperable closed position.

11. The rotary valve of claim 1 wherein said rotary valve has an end portion rotatably functioning as an impeller to stir liquid, gel, or slurry within an impeller displacement zone.

12. The rotary valve of claim 1 wherein said second channel pathway is generally X-shaped and has an upper distal side opening, an upper proximal side opening, a lower distal side opening, and a lower proximal side opening.

13. The rotary valve of claim 12 wherein said upper proximal side opening or said lower proximal side opening of said second channel pathway defines a point of entry for said liquid, gel, or slurry from said piston pump assembly to said valve body when said second channel pathway is in its operative discharge position.

14. The rotary valve of claim 12 wherein said upper distal side opening or said lower distal side opening of said second channel pathway defines a discharge exit for said liquid, gel, or slurry provided to said valve body when said second channel pathway is in its operative discharge position.

15. The rotary valve of claim 12 wherein either said upper proximal side opening and said lower distal side opening of said second channel pathway or said lower proximal side opening and said upper distal side opening of said second channel pathway defines an angled discharge pathway for said liquid, gel, or slurry through said valve body when said second channel pathway is in its operative discharge position.

16. The rotary valve of claim 12 wherein said first channel pathway further includes a second inlet opening substantially axially aligned with said inlet opening and wherein said valve body is rotatable to four cycle locations, a first cycle location being a first operative position of said first channel pathway wherein liquid, gel, or slurry is provided to a pathway of the piston pump assembly, and a first inoperative position-of said second channel pathway, a second cycle location being a first operative position of said second channel pathway wherein said upper proximal side opening and said lower distal side opening of said second channel pathway defines a discharge pathway for said liquid, gel, or slurry and a first inoperative position of said first channel pathway, a third cycle location being a second operative position of said first channel pathway wherein liquid, gel, or slurry is provided to a pathway of the piston pump assembly, and a second inoperative position of said second channel pathway, and a fourth cycle location being a second operative position of said second channel pathway wherein said lower proximal side opening and said upper distal side opening of said second channel pathway defines a discharge pathway for said liquid, gel, or slurry and a second inoperative position of said first channel pathway.

17. The rotary valve of claim 16 wherein said four cycle locations respectively correspond to four quarterly turns of said rotary valve.

18. A piston pump rotary valve assembly for use in discharging a metered amount of liquid, gel, or slurry comprising a piston body attached to a valve housing, said piston body having a piston bore pathway therein communicative with a valve body set within said valve housing, a piston operable to a withdraw recharge cycle position and a drive discharge cycle position within said piston bore pathway, a valve body set within said valve housing having a first channel pathway and a second channel pathway, said first channel pathway of said valve body having an inlet opening to receive a liquid, gel, or slurry and an outlet opening to provide said liquid, gel, or slurry to said piston bore pathway of said piston body during said withdraw recharge cycle position of said piston, said second channel pathway of said valve body having a plurality of inlet openings each capable of communicative alignment with said piston bore pathway and at least one outlet opening communicative with said inlet openings, said valve body being capable of rotation with respect to said piston body to dispose said inlet opening of said first channel pathway to an operative position to receive fluid communication of said liquid, gel, or slurry through said first channel pathway and provide the same to said piston bore pathway and an inoperative position closing said first channel pathway from such fluid communication, said valve body being capable of rotation with respect to said piston body to dispose said second channel pathway to an operative position to receive said liquid, gel, or slurry from said piston bore pathway during a drive discharge position of said piston assembly and an inoperative position to prevent said reception, and a nozzle having a discharge bore interconnected with said valve housing, said discharge bore being communicative with said second channel pathway during its operative position to dispense said liquid, gel, or slurry.

19. The piston pump rotary valve assembly of claim 18 wherein said first channel pathway further includes a second intake opening substantially aligned with said intake opening and a second outlet opening.

20. The piston pump rotary valve assembly of claim 18 wherein said second channel pathway rotates on a vertical axis relative said piston body.

21. The piston pump rotary valve assembly of claim 18 wherein said valve body has an end portion rotatably functioning as an impeller to stir liquid, gel, or slurry within an impeller displacement zone.

22. The rotary valve of claim 18 wherein said second channel pathway is generally X-shaped and has an upper distal side opening, an upper proximal side opening, a lower distal side opening, and a lower proximal side opening.

23. The piston pump rotary valve assembly of claim 22 wherein said upper proximal side opening or said lower proximal side opening of said second channel pathway receives said liquid, gel, or slurry from said piston bore pathway when said second channel pathway is i n its operative position.

24. The piston pump rotary valve assembly of claim 22 wherein said upper distal side opening or said lower distal side opening of said second channel defines a discharge exit to said nozzle for said liquid, gel, or slurry provided to said valve body when said second channel pathway is in its operative position.

25. The piston pump rotary valve assembly of claim 22 wherein either said upper proximal side opening and said lower distal side opening of said second channel pathway or said lower proximal side opening and said upper distal side opening of said second channel pathway defines an angled discharge pathway for said liquid, gel, or slurry through said valve body when said second channel pathway is in its operative position.

26. The piston pump rotary valve assembly of claim 22 wherein said valve body further includes a second inlet opening substantially axially aligned with said inlet opening and wherein said valve body is rotatable to four cycle locations, a first cycle location being a first operative position of said first channel pathway wherein liquid, gel, or slurry is provided to said piston bore pathway of said piston body, and a first inoperative position of said second channel pathway, a second cycle location being a first operative position of said second channel pathway wherein said upper proximal side opening and said lower distal side opening of said second channel pathway defines a discharge pathway for said liquid, gel, or slurry and a first in operative position of said first channel pathway, a third cycle location being a second operative position of said first channel pathway wherein liquid, gel, or slurry is provided to said piston bore pathway of said piston body, and a second inoperative position of said second channel pathway, and a fourth cycle location being a second operative position of said second channel pathway wherein said lower proximal side opening and said upper distal side opening of said second channel pathway defines a discharge pathway for said liquid, gel, or slurry and a second inoperative position of said first channel pathway.

27. The piston pump rotary valve assembly of claim 26 wherein said four cycle locations respectively correspond to four quarterly turns of said valve body.

28. A piston pump rotary valve assembly tank dispenser for discharging, a metered amount of liquid, gel, or slurry comprising a fill tank for supplying a liquid, gel, or slurry, a piston pump rotary valve assembly attached to and communicative with said tank, said piston pump assembly including a piston body attached to a valve housing, said piston body having a piston bore pathway therein communicative with a valve body set within said valve housing, a piston operable to a withdraw recharge cycle position and a drive discharge cycle position within said piston bore pathway, a valve body set within said valve housing and extending at least partially within said fill tank, said valve body having a first channel pathway and a second channel pathway, said first channel pathway of said valve body having an inlet opening extended within said fill tank to receive a liquid, gel, or slurry of said fill tank and to provide the same to said piston bore pathway of said piston body during said withdraw recharge cycle position of said piston, said second channel pathway of said valve body having a plurality of inlet openings each capable of communicative alignment with said piston bore pathway and at least one outlet opening communicative with said inlet openings, said valve body being capable of rotation with respect to said piston body to dispose said inlet opening of said first channel pathway to both an operative position to receive said liquid, gel, or slurry and provide the same to said piston bore pathway and an inoperative position closing said first channel pathway from fluid communication with said liquid, gel, or slurry, said valve body being capable of rotation with respect to said piston body to dispose said second channel pathway to an operative position to receive said liquid, gel, or slurry from said piston bore pathway during a drive discharge position of said piston assembly and an inoperative position to prevent said reception, and a nozzle having a discharge bore interconnected with said valve housing, said discharge bore being communicative with said second channel pathway during its operative position to dispense said liquid, gel, or slurry.

29. The piston pump rotary valve assembly tank dispenser of claim 28 wherein said first channel pathway further includes a second intake opening substantially aligned with said intake opening and a second outlet opening.

30. The piston pump rotary valve assembly tank dispenser of claim 28 further including a plurality of said piston pump rotary valve assemblies attached to and in fluid communication with said fill tank.

31. The piston pump rotary valve assembly tank dispenser of claim 28 wherein said second channel pathway rotates on a vertical axis relative said piston body.

32. The piston pump rotary valve assembly tank dispenser of claim 28 wherein said valve body has an end portion rotatably functioning as an impeller to stir liquid, gel, or slurry within an impeller displacement zone.

33. The piston pump rotary valve assembly tank dispenser of claim 28 wherein said second channel pathway is generally X-shaped and has an upper distal side opening, an upper proximal side opening, a lower distal side opening, and a lower proximal side opening.

34. The piston pump rotary valve assembly tank dispenser of claim 33 wherein said upper proximal side opening or said lower proximal side opening of said second channel pathway receives said liquid, gel, or slurry from said piston bore pathway when said second channel pathway is in its operative position.

35. The piston pump rotary valve assembly tank dispenser of claim 33 wherein said upper distal side opening or said lower distal side opening of said second channel defines a discharge exit to said nozzle for said liquid, gel, or slurry provided to said valve body when said second channel pathway is in its operative position.

36. The piston pump rotary valve assembly tank dispenser of claim 33 wherein either said upper proximal side opening and said lower distal side opening of said second channel pathway or said lower proximal side opening and said upper distal side opening of said second channel pathway defines an angled discharge pathway for said liquid, gel, or slurry through said valve body when said second channel pathway is in its operative position.

37. The piston pump rotary valve assembly tank dispenser of claim 33 wherein said valve body further includes a second inlet opening substantially axially aligned with said inlet opening and wherein said valve body is rotatable to four cycle locations, a first cycle location being a first operative position of said first channel pathway wherein liquid, gel, or slurry is provided to said piston pathway bore of said piston body, and a first inoperative position of said second channel pathway, a second cycle location being a first operative position of said second channel pathway wherein said upper proximal side opening and said lower distal side opening of said second channel pathway defines a discharge pathway for said liquid, gel, or slurry, and a first inoperative position of said first channel pathway, a third cycle location being a second operative position of said first channel pathway wherein liquid, gel, or slurry is provided to said pathway bore of said piston body, and a second inoperative position of said second channel pathway, and a fourth cycle location being a second operative position of said second channel pathway wherein said lower proximal side opening and said upper distal side opening of said second channel pathway defines a discharge pathway for said liquid, gel, or slurry, and a second inoperative position of said first channel pathway.

38. The piston pump rotary valve assembly tank dispenser of claim 37 wherein said four cycle locations respectively correspond to four quarterly turns of said valve body.

* * * * *